US006789283B2

(12) United States Patent
Pirzada

(10) Patent No.: US 6,789,283 B2
(45) Date of Patent: Sep. 14, 2004

(54) FLUID FILLED SUPPORT WITH A PORTABLE PRESSURE ADJUSTING DEVICE

(76) Inventor: Shahzad Pirzada, 1 Tiffany Cir., Manhasset, NY (US) 11030

( * ) Notice: Subject to any disclaimer, the term of this patent is extended or adjusted under 35 U.S.C. 154(b) by 119 days.

(21) Appl. No.: 10/162,279

(22) Filed: Jun. 4, 2002

(65) Prior Publication Data

US 2002/0148046 A1 Oct. 17, 2002

Related U.S. Application Data

(63) Continuation-in-part of application No. 09/812,166, filed on Mar. 19, 2001, now Pat. No. 6,564,411.

(51) Int. Cl.[7] ..... A47C 27/10; A61G 7/057

(52) U.S. Cl. ..... 5/713; 5/710; 5/654; 5/655.3

(58) Field of Search ..... 5/713, 710, 706, 5/644, 654, 655.3, 702, 655.4, 689, 911, 912, 712

(56) References Cited

U.S. PATENT DOCUMENTS

| | | | | | |
|---|---|---|---|---|---|
| 201,728 | A | | 3/1878 | White | 5/707 |
| 3,653,083 | A | | 4/1972 | Lapidus | 5/713 |
| 3,778,851 | A | * | 12/1973 | Howorth | 5/423 |
| 3,822,425 | A | * | 7/1974 | Scales | 5/710 |
| 3,875,599 | A | | 4/1975 | Mrcek et al. | 5/706 |
| 4,477,935 | A | | 10/1984 | Griffin | 5/241 |
| 4,644,597 | A | | 2/1987 | Walker | 5/711 |
| 4,662,012 | A | | 5/1987 | Torbet | 5/713 |
| 4,686,722 | A | | 8/1987 | Swart | 5/713 |
| 4,768,250 | A | * | 9/1988 | Kato | 5/689 |
| 4,797,962 | A | | 1/1989 | Goode | 5/713 |
| 4,864,671 | A | * | 9/1989 | Evans | 5/713 |
| 4,888,836 | A | | 12/1989 | Calderwood | 5/10.2 |
| 4,907,307 | A | | 3/1990 | Weitzler | 5/665 |
| 4,908,895 | A | | 3/1990 | Walker | 5/711 |
| 4,914,760 | A | * | 4/1990 | Hargest et al. | 5/689 |
| 4,942,635 | A | * | 7/1990 | Hargest et al. | 5/689 |
| 4,967,431 | A | * | 11/1990 | Hargest et al. | 5/689 |
| 4,982,466 | A | * | 1/1991 | Higgins et al. | 5/713 |
| 4,989,283 | A | | 2/1991 | Krouskop | 5/713 |
| 5,020,176 | A | | 6/1991 | Dotson | 5/710 |
| 5,029,352 | A | * | 7/1991 | Hargest et al. | 5/689 |
| 5,033,133 | A | | 7/1991 | Nissen | 5/653 |
| 5,036,559 | A | * | 8/1991 | Hargest | 5/689 |
| 5,052,067 | A | | 10/1991 | Thomas et al. | 5/713 |
| 5,070,560 | A | | 12/1991 | Wilkinson | 5/710 |
| 5,079,785 | A | * | 1/1992 | Garcia | 5/654 |
| 5,090,076 | A | | 2/1992 | Guldager | 5/713 |
| 5,090,077 | A | | 2/1992 | Caden et al. | 5/713 |
| 5,103,519 | A | | 4/1992 | Hasty | 5/715 |
| 5,129,115 | A | * | 7/1992 | Higgins et al. | 5/713 |
| 5,249,318 | A | | 10/1993 | Loadsman | 5/710 |
| 5,267,364 | A | | 12/1993 | Volk | 5/713 |
| 5,375,273 | A | | 12/1994 | Bodine, Jr. et al. | 5/710 |
| 5,421,044 | A | | 6/1995 | Steensen | 5/710 |

(List continued on next page.)

*Primary Examiner*—Robert G. Santos
(74) *Attorney, Agent, or Firm*—Collard & Roe, P.C.

(57) ABSTRACT

The invention relates to a fluid filled support comprising a plurality of chambers in fluid communication with each other at least one fluid conduit interconnecting at least two of the plurality of chambers together. There is also at least one connection head coupled to the at least one fluid conduit. There is also at least one portable pump which is connectable to the connection head. This portable pump is for inserting additional fluid into the fluid conduit wherein the fluid then flows into the plurality of chambers. There is also a portable pressure relief device which is connectable to the connection head. This device comprises a pressure gauge for determining a pressure of fluid inside the fluid filled support. The pressure gauge also includes an adjustable pressure relief valve which is adjustable to relieve fluid from the support wherein the at least one portable pump and the at least one portable pressure relief device are used to adjust pressure in the system. With this design, the portable pump and the portable pressure relief device are coupled together in a single portable pressure adjusting device.

11 Claims, 4 Drawing Sheets

U.S. PATENT DOCUMENTS 5,487,196 A 1/1996 Wilkinson et al. ..... 5/715
5,487,197 A * 1/1996 Iskra et al. ..... 5/654
5,539,942 A 7/1996 Melou ..... 5/655.3
5,542,136 A 8/1996 Tappel ..... 5/710
5,560,057 A 10/1996 Madsen et al. ..... 5/715
5,584,085 A 12/1996 Banko ..... 5/710
5,586,346 A 12/1996 Stacy et al. ..... 5/710
5,594,963 A 1/1997 Berkowitz ..... 5/713
5,611,096 A 3/1997 Bartlett et al. ..... 5/617
5,630,237 A 5/1997 Ku ..... 5/420
5,634,225 A 6/1997 Miller, Sr. et al. ..... 5/710
5,659,908 A 8/1997 Nishino ..... 5/676
5,685,036 A 11/1997 Kopfstein et al. ..... 5/713
5,699,570 A * 12/1997 Wilkinson et al. ..... 5/713
5,708,999 A * 1/1998 Priolo et al. ..... 5/644
5,787,531 A 8/1998 Pepe ..... 5/710
5,794,288 A 8/1998 Soltani et al. ..... 5/713
5,873,137 A 2/1999 Yavets-Chen ..... 5/713
5,893,184 A 4/1999 Murphy ..... 297/452.41
5,898,963 A * 5/1999 Larson ..... 5/644
5,906,205 A * 5/1999 Hiebert ..... 128/845
5,920,934 A 7/1999 Hannagan et al. ..... 5/713
5,970,545 A * 10/1999 Garman et al. ..... 5/615
5,983,429 A 11/1999 Stacy et al. ..... 5/713
6,014,784 A 1/2000 Taylor et al. ..... 5/713
6,047,423 A 4/2000 Larson ..... 5/709
6,065,166 A * 5/2000 Sharrock et al. ..... 5/630
6,108,843 A 8/2000 Suzuki et al. ..... 5/713
6,148,461 A * 11/2000 Cook et al. ..... 5/713
6,253,401 B1 * 7/2001 Boyd ..... 5/713
6,266,833 B1 7/2001 Lin ..... 5/713
6,269,505 B1 8/2001 Wilkinson ..... 5/713
6,349,439 B1 2/2002 Cook et al. ..... 5/713
6,412,129 B1 7/2002 Wu ..... 5/713
6,715,171 B2 * 4/2004 Grabe ..... 5/644
2001/0052152 A1 * 12/2001 Soltani et al. ..... 5/689
2002/0148046 A1 * 10/2002 Pirzada ..... 5/713
2003/0159219 A1 * 8/2003 Harrison et al. ..... 5/713
2003/0200611 A1 * 10/2003 Chaffee ..... 5/710
2003/0208849 A1 * 11/2003 Wilkinson ..... 5/713

* cited by examiner

FLUID FILLED SUPPORT WITH A PORTABLE PRESSURE ADJUSTING DEVICE

CROSS REFERENCE TO RELATED APPLICATIONS

This application is a Continuation In Part Application of U.S. patent application Ser. No. 09/812,166 titled "Active Fluid Channeling System For a Bed" filed on Mar. 19, 2001 incorporated herein by reference and wherein priority is claimed under 35 U.S.C. §120 wherein this application is issued as U.S. Pat. No. 6,564,411 on May 20, 2003.

BACKGROUND

The invention relates to a fluid filled support such as a mattress or a cushion which can connect to a separate pump as well as pressure relief mechanism having a pressure gauge. This type support is needed to balance the pressure on an individual across the contact surface between the individual and the fluid filled support. By distributing the load of an individual across the contact surface, it reduces the occurrence of harmful pressure sores.

Passive supports or supports that offer static or continuous support across a surface area may cause pressure points on an individual because of the unevenly distributed weight of a person at certain points of their body. A dynamic support that offers different levels of support across its surface area is an improvement over this static design because it helps to even out the pressure across the contact surface of the individual on the support thus lowering the incidence of sores.

Support systems that contain a dynamic fluid flow system act as dynamic support systems evening out the support across a person's body which evens out the pressure on that individual.

SUMMARY

The invention relates to a fluid filled support comprising a plurality of chambers in fluid communication with each other with fluid conduits interconnecting at least two of the chambers together. There is also one or more one-way valves disposed in these fluid conduits. There is also at least one connection head coupled to the fluid conduit. There is also at least one portable pressure adjusting device having a pump which is connectable to the connection head. This portable pump is for inserting additional fluid into the fluid conduit wherein the fluid then flows into the plurality of chambers.

The pressure adjusting device includes a portable pressure relief device which is connectable to the connection head. This device comprises a pressure gauge for determining a pressure of fluid inside the fluid filled support. The pressure gauge also includes an adjustable pressure relief valve which is adjustable to relieve fluid from the support wherein the at least one portable pump and the at least one portable pressure relief device are used to adjust pressure in the system. With this design, the portable pump and the portable pressure relief device are coupled together in a single portable pressure adjusting device. The portable pump can contain an electric pump motor for pumping fluid into the device. In another embodiment, the portable pump can contain a manual pump for pumping fluid into the device.

With this design, portable pump can be in electronic communication with the pressure gauge wherein the portable pump stops pumping when the fluid filled support reaches an internal pressure preset on the pressure gauge.

This design creates a more efficient system because the pump, the pressure gauge, and the pressure relief valve can be incorporated into one portable unit rather than having each single bed incorporating a pump and a pressure relief valve.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1:
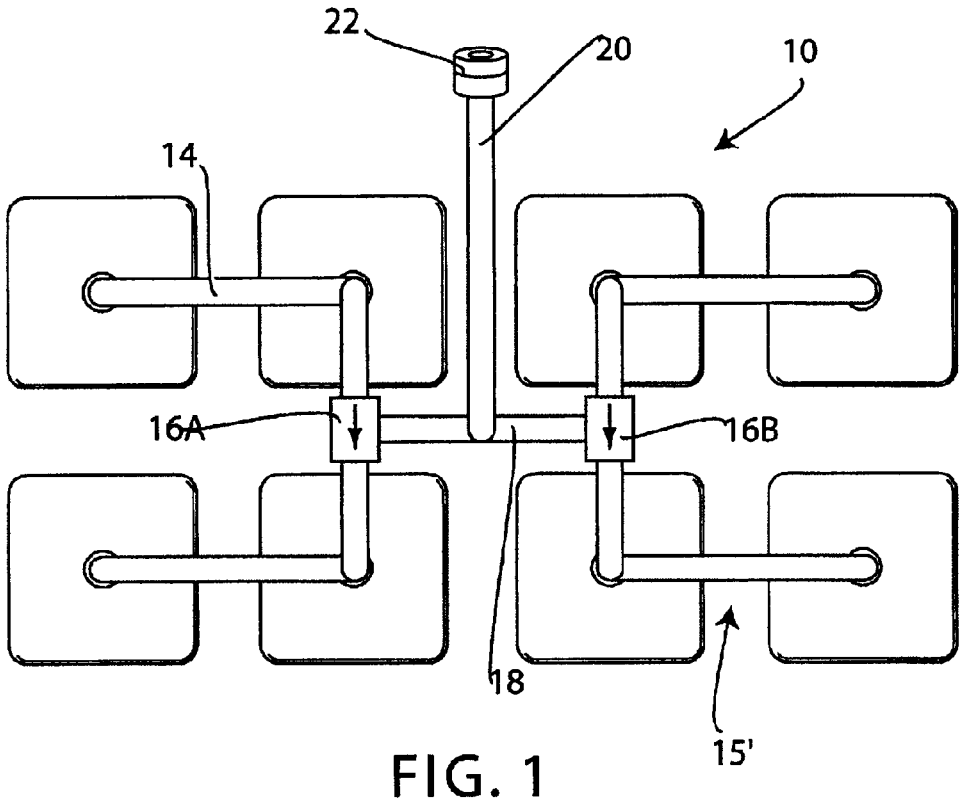
FIG. 1 is a front schematic view of the device.
Figure 4A:
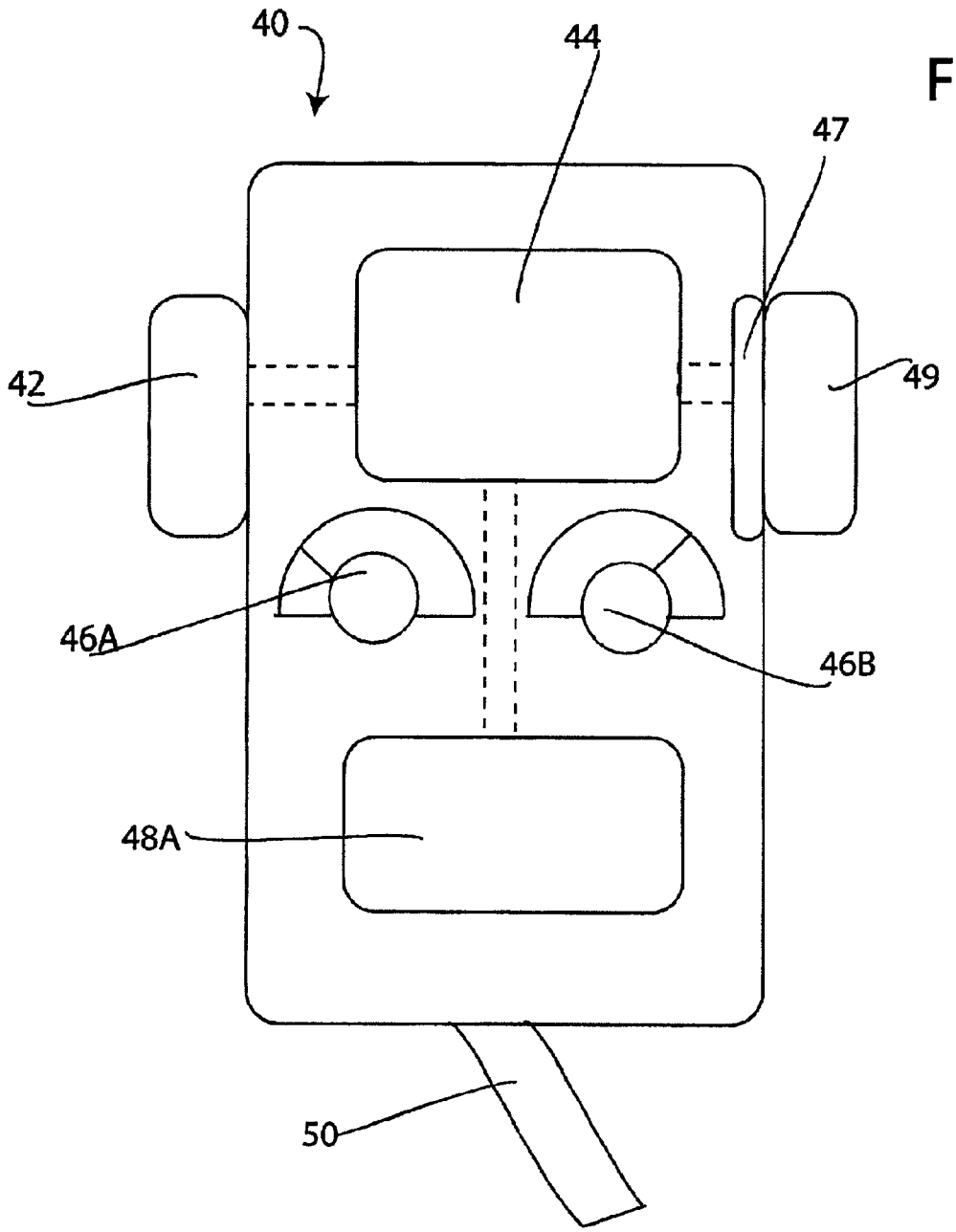
FIG. 4 is a schematic block diagram of the portable pressure adjusting device.
Figure 4B:
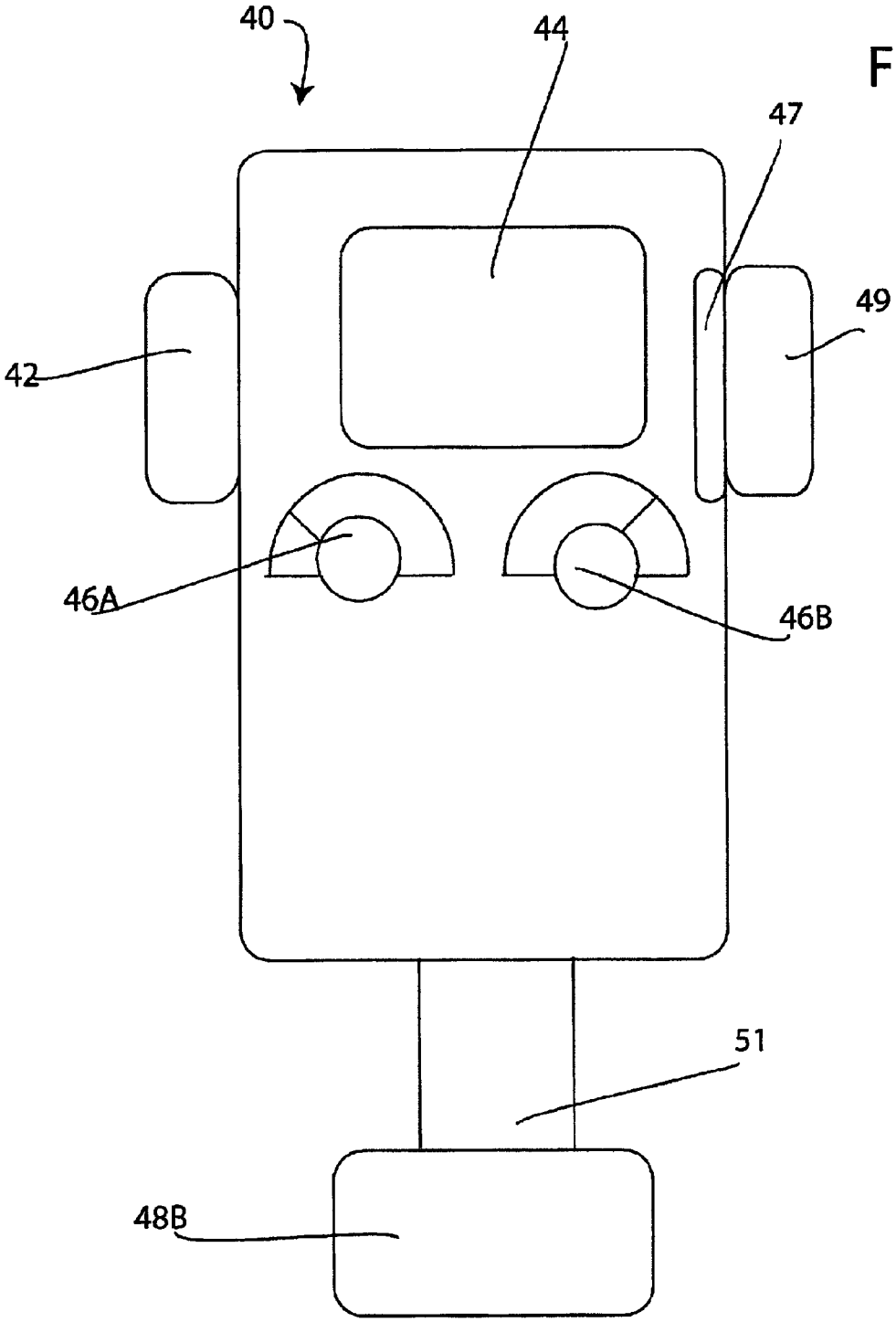

Referring to the drawings, FIG. 1 is a front schematic view of the device which is a fluid filled support which is connectable to a portable pressure adjusting device (see FIGS. 4A and 4B). This device 10 includes a plurality of chambers 12 which are fluid filled with a fluid such as air. Each chamber 12 is connectable to the other via a manifold system containing a plurality of conduits 14. Conduits 14 form a first set of conduits 15 and a second set of conduits 15'. There are also a plurality of one way valves with a first one way valve 16A disposed in the first set of conduits 15 and a second one way valve 16B disposed in the second set of conduits 15'. These conduit set 15 and 15' are connectable to each other via a central connector 19. There is also an outlet conduit 20 which is coupled to central connector 18. Outlet conduit 20 allows fluid such as air to flow out to a head or tap 22. Tap 22 is essentially a connecting valve which allows the fluid system to connect to a portable pressure adjusting device 40 shown in FIG. 4.

Figure 2:
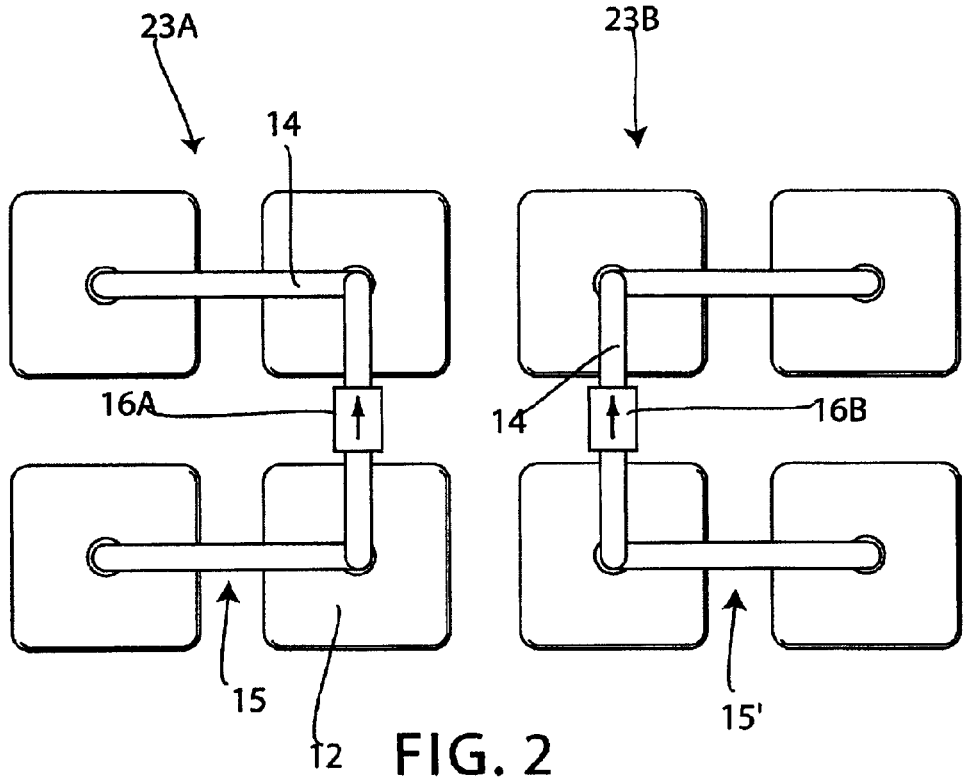
FIG. 2 is a back schematic view of the device.

FIG. 2 is a back schematic view of the device 10 which includes chambers 12 connected together via a manifold system which includes a plurality of conduits 14 forming a first set of conduits 15 and a second set of conduits 15'. With this view, there is no central connector 18, shown and there is no outlet conduit 20 which allows air or fluid to flow into head or tap 22. With this back view, it is clear that there are essentially two different sets of conduits 15 and 15' which control two different sets of chambers 12. Essentially there is a first set of chambers 23A and a second set of chambers 23B shown in FIG. 2 wherein fluid only flows between these chambers via central connector 16.

Figure 3:
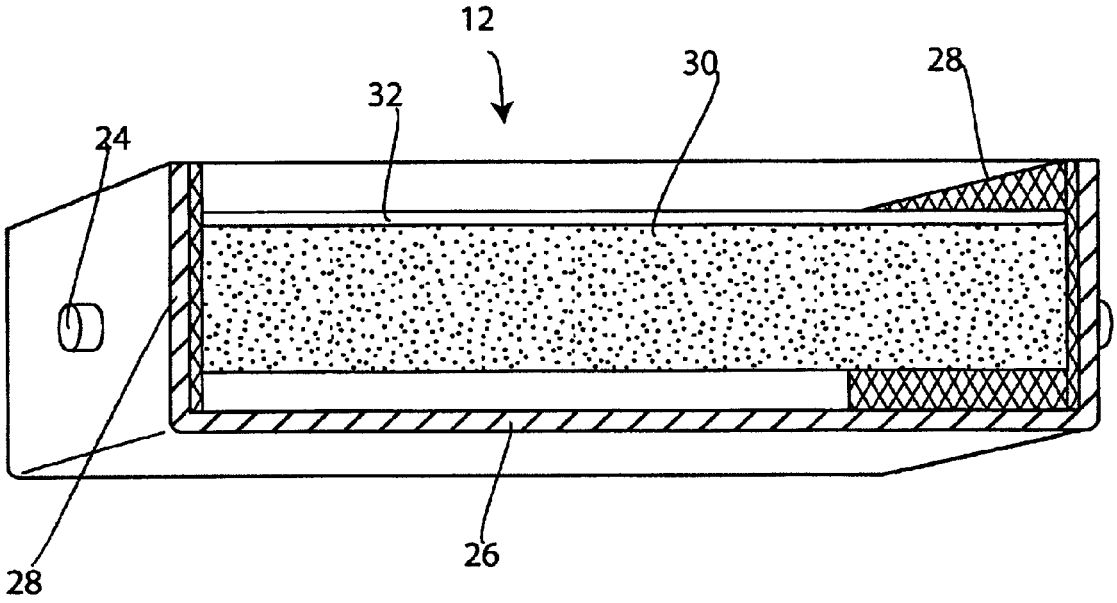
FIG. 3 is a side cross sectional view of the chamber.

FIG. 3 is a side cross sectional view of an individual chamber 12. In this view, chamber 12 includes an inlet 24 which is connectable to conduits 14. In addition, as shown chamber 12 has a chamber shell or lining 26 which helps to keep the structural consistency of the chamber 12 as the chamber 12 increases or decreases in volume due to a change in fluid pressure inside of each chamber. There is also shown an air filter screen 28 which is disposed inside of chamber 12. Air filter screen is designed to keep solid pellets 30 inside of chamber 12. If air filter screen was not disposed inside of chamber 12, solid pellets 30 would flow out of chamber 12 and into manifold 14. There are also plurality of plastic tubes 32 which are disposed inside of chamber 12.

FIG. 4A is a schematic block diagram of a first embodiment of the portable pressure adjusting device 40. This portable pressure adjusting device includes an input/output port 42, a pressure gauge 44 a plurality of pressure adjusting dials 46A and 46B, for adjusting a pressure relief valve 47, a powered pump 48A and an output port 49. Input/output port 42 connects to tap 22 either directly or via a hose or any other type of flexible connection (not shown). When portable pressure adjusting device 40 is connected to device 10, pressure gauge 44 determines the pressure level in the system. Pressure adjusting dials 46A and 46B set a low and a high range for the pressure allowed in device 10. IF the pressure in the system is between the pressure range then the pressure is not adjusted in the system. However, if the pressure in the system is below the range, then powered pump 48A turns on and sends additional fluid such as air into the system to increase the pressure in the system. If the pressure in the system is above the range then pressure relief valve 47 allows fluid to flow out of output port 49 to adjust the pressure back within range. Once the pressure in the system falls back within the selected range then pressure relief valve 47 closes ending the fluid flow outside the system.

FIG. 4B shows a second embodiment of the system wherein the portable pressure adjusting device contains a manually powered pump 48B which can be attached to the system via a flexible fluid connector such as a hose 51. Manually powered pump 48B is pumped by a user's hand or foot. With this device, pressure gauge 44 and pressure adjusting dials 46A and 46B are operated hydraulically to control the pressure in the system.

Accordingly, while at least one embodiment of the present invention has been shown and described, it is to be understood that many changes and modifications may be made thereunto without departing from the spirit and scope of the invention as defined in the appended claims.

What is claimed is:

1. A fluid filled support comprising:

a) a plurality of chambers in fluid communication with each other;

b) at least one fluid conduit interconnecting at least two of said plurality of chambers together;

c) at least one connection head coupled to said at least one fluid conduit;

d) at least one portable pump which is connectable to said connection head, said portable pump for inserting additional fluid into said at least one fluid conduit wherein said fluid then flows into to least one of said plurality chambers;

e) at least one portable pressure relief device which is connectable to said connection head, said device comprising:

i) a pressure gauge for determining a pressure of fluid inside said fluid filled support; and ii) an adjustable pressure relief valve which is adjustable to relieve fluid from said support;

iii) at least one pressure adjuster which is used to adjust a pressure at which said at least one portable pump turns on to add fluid to the fluid filled support or at which said adjustable pressure relief valve releases fluid out of the support, wherein said at least one pressure adjuster is in the form of at least one manually operable pressure adjusting dial coupled to said at least one portable pump and said at least one portable pressure relief device wherein said at least one portable pump and said at least one portable pressure relief device are used to adjust pressure in the system.

2. The fluid filled support as in claim 1, wherein said at least one portable pump and said at least one portable pressure relief device are coupled together in a single portable unit.

3. The fluid filled support as in claim 1, further comprising at least one one-way valve disposed in said at least one fluid conduit, said at least one one-way valve for controlling the fluid flow in said fluid filled support.

4. The fluid filled support as in claim 1, wherein said at least one portable pump contains an electric pump motor for pumping fluid into the device.

5. The fluid filled support as in claim 1, wherein said at least one portable pump contains a manual pump for pumping fluid into the device.

6. The fluid filled support as in claim 1, wherein said at least one portable pump is in electronic communication with said at least one pressure gauge wherein said at least one portable pump stops pumping when said fluid filled support reaches an internal pressure preset on said pressure gauge.

7. The fluid filled support as in claim 1, wherein said device further comprises a plurality of pellets disposed inside said plurality of chambers.

8. The fluid filled support as in claim 7, further comprising an air filter screen disposed inside of said chamber, wherein said air filter screen keeps said plurality of pellets inside of said plurality of chambers.

9. The device as in claim 1, further comprising a plurality of tubes disposed inside of said plurality of chambers.

10. The device as in claim 7, wherein said a plurality of pellets are solid pellets.

11. The device as in claim 2, wherein said at least one pressure adjuster comprises at least two pressure adjusting units comprising at least one adjustable low pressure dial and at least one adjustable high pressure dial for setting an appropriate pressure range, wherein if the pressure in the support is below a setting on the adjustable low pressure dial said portable pump, turns on, pumping additional fluid into the support, or if the pressure in the system is higher than a setting on the adjustable high pressure dial than said pressure relief valve relieves pressure in the support by releasing fluid from the support.

* * * * *